US005127251A

United States Patent [19]

Casagrande et al.

[11] Patent Number: 5,127,251

[45] Date of Patent: Jul. 7, 1992

[54] CANTILEVERED ROLLING MILL ASSEMBLY

[76] Inventors: Bruno Casagrande, Via Malignani, 3, 33074 Fontanafredda (Pordenone); Ferruccio Zuccato, Via Trieste, 72, 33031 Basiliano fr. Variano (Udine), both of Italy

[21] Appl. No.: 692,962

[22] Filed: Apr. 26, 1991

Related U.S. Application Data

[63] Continuation of Ser. No. 385,180, Jul. 26, 1989, abandoned.

[30] Foreign Application Priority Data

Aug. 31, 1988 [IT] Italy ..... 2178 A/88
Apr. 4, 1989 [IT] Italy ..... 20001 A/89

[51] Int. Cl.[5] ..... B21B 31/10; B21B 31/26; B21B 35/14

[52] U.S. Cl. ..... 72/239; 72/248; 72/249

[58] Field of Search ..... 72/238, 239, 249, 248

[56] References Cited

U.S. PATENT DOCUMENTS

| | | | |
|---|---|---|---|
| 3,043,170 | 7/1962 | Wales | 72/221 |
| 3,336,781 | 8/1967 | Wilson et al. | 72/235 |
| 3,945,234 | 3/1976 | Steinbock | 72/238 |
| 4,008,598 | 2/1977 | Percupile et al. | 72/238 |
| 4,182,149 | 1/1980 | Wilson | 72/249 |
| 4,446,712 | 5/1984 | Stone et al. | 72/243 |
| 4,653,304 | 3/1987 | Feldmann et al. | 72/239 |
| 4,924,689 | 5/1990 | Wilson | 72/249 |

FOREIGN PATENT DOCUMENTS

| | | | |
|---|---|---|---|
| 3214412 | 12/1982 | Fed. Rep. of Germany | 72/235 |
| 0132451 | 11/1978 | Japan | 72/239 |
| 1047562 | 10/1983 | U.S.S.R. | 72/238 |

*Primary Examiner*—Lowell A. Larson
*Assistant Examiner*—Thomas C. Schoeffler
*Attorney, Agent, or Firm*—Shlesinger, Fitzsimmons, Shlesinger

[57] ABSTRACT

A rolling mill assembly (1) for metal sections equipped with a drive assembly (27) comprising means (7) of rotating a pair of shafts (2, 3) each of which supports a rolling mill roll (12, 13) locked between two supports (16, 17), said drive assembly (27) having a front frame (6), said pair of shafts (2, 3) supporting in an axially removable manner said rolls (12, 13) and being supported at both ends by a pair of uprights (4, 5) forming a stand (26), one (5) of the uprights of said pair (4, 5) being designed to be made transiently and frontally integral with said front frame (6), said rotating means (7) being made continuously and coaxially integral with said pair of shafts (2, 3) when the stand (26) is mounted on the drive assembly (27), there being provided eccentric means (8, 8', 8'') of containment, guide and positioning of the shafts (2, 3, 7) for center to center distance adjustment of said rolls (12, 13).

7 Claims, 1 Drawing Sheet

CANTILEVERED ROLLING MILL ASSEMBLY

This application is a continuation of our application Ser. No. 07/385,180, which was filed Jul. 26, 1989 and which is now abandoned.

The object of the present invention is an improved rolling mill assembly.

More specifically the object of the present invention is a rolling mill assembly usable in a horizontal, vertical or inclined position.

There are rolling mills in the known art having shafts supported at the sides and in which each roll is integral with the entire corresponding roll: this type of rolling mill assembly has many drawbacks since in case of wear of the roll it requires replacement of the shaft including its supports.

The supports are generally subject to much less wear than the rings and therefore do not require such frequent replacement.

Replacing the entire shaft involves waste of material still usable and hence very considerable costs.

Furthermore the arrangement of the shafts on the uprights makes necessary practically complete disassembly of the machine to perform a replacement.

There are also known in the art rolling mill assemblies in which the shafts are supported in a cantilevered manner, i.e. they are supported at only one end.

Such assemblies are also equipped with interchangeable rolling mill rolls which can be removed from the free part of the machine.

These rolling mill assemblies are not however satisfactory because they are not as effective with heavy rolling loads as with a double support.

This leads to undesired bending along the axes of the shafts and/or at the points of support of the latter at the upright with the resulting rolling defects.

To obviate these drawbacks the applicants have invented a rolling mill assembly with a monobloc stand having a double support in accordance with the disclosure herein.

The claims characterize specific aspects of the invention.

The annexed drawing contains figures which are illustrative and are presented as examples.

Figure 1:
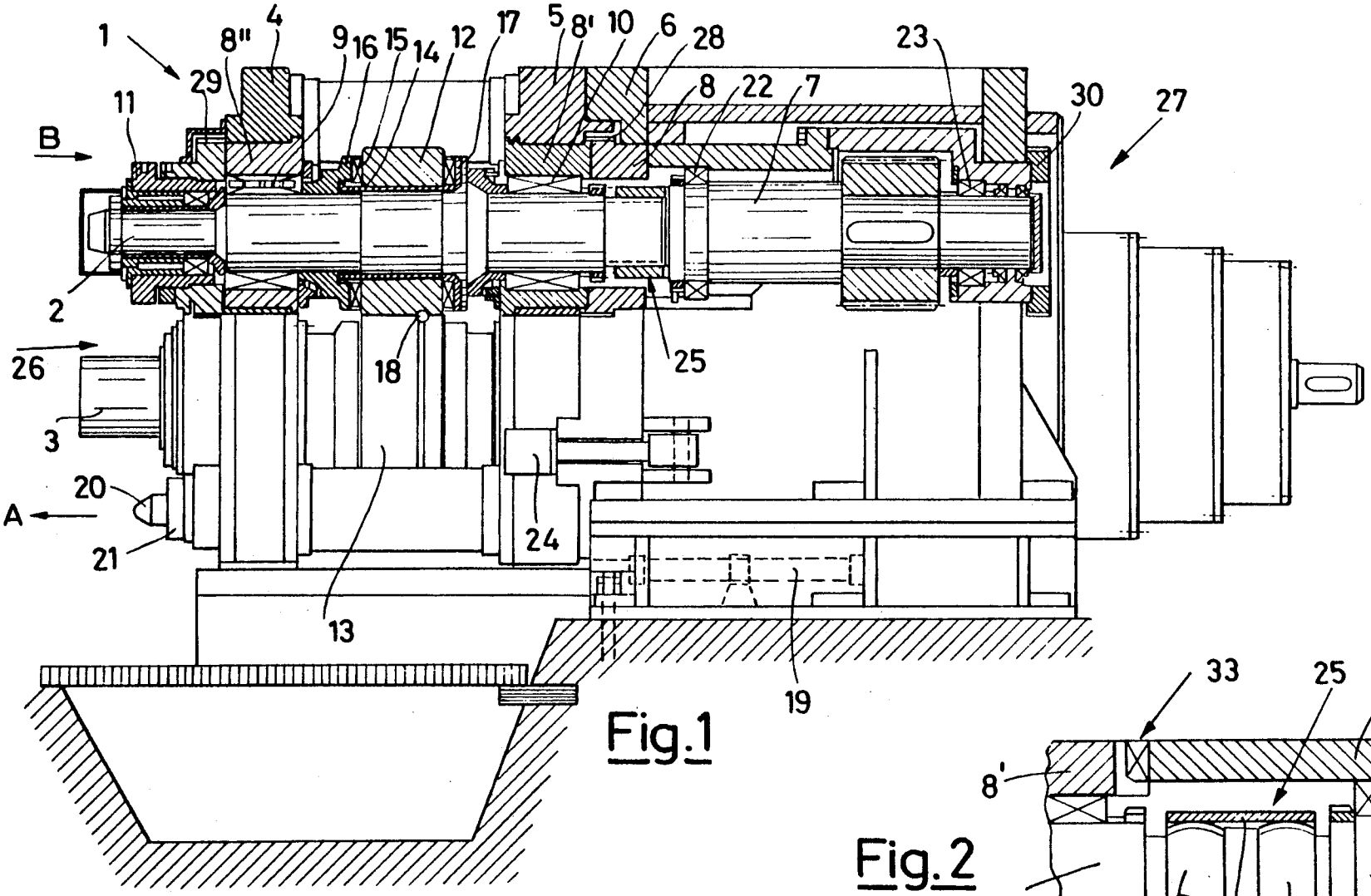
FIG. 1 illustrates an example of accomplishment of the invention.

The rolling mill assembly 1 comprises a monobloc stand 26 and a drive assembly 27.

The stand 26 comprises generally a pair of shafts 2, 3 supported by a pair of main bearings 9, 10 working together with uprights 4, 5 and a drive assembly 27.

The upright 5 is in turn removably secured against lateral movement with a supporting frame 6 constituting the front part of the drive assembly 27 equipped with shafts 7 for rotating the shafts 2, 3 which are essentially coaxial with the respective shafts 7.

Shafts 7 are in turn supported by roller bearings 22, 23.

The radial distance between the shafts 2, 3 and their respective drive shaft 7 is adjustable by means of an eccentric support mechanism 8, 8', 8''.

The eccentric support mechanism 8, 8', 8'' supports coaxially with the shafts 2 and 3 the respective shafts 7.

Acting upon the eccentric support mechanism 8, 8', 8'' adjusts simultaneously the center to center distance both of the shafts 2 and 3 and of the respective shafts 7 so that the shafts 7 remain coaxial with their respective shafts 2 or 3 although their center to center distance may vary.

The stand 26 also bears, corresponding with each shaft 2, 3, a movable brushing 11 designed to effect axial adjustment of the positions of the shafts 2, 3.

Each of the shafts 2, 3 works with a respective rolling mill roll 12 or 13.

The rolling mill rolls 12, 13 bear on their circumferential surfaces rolling sections for one or more rolling mill products 18.

In the example shown the rolls 12, 13 are made integral with the respective shafts 2, 3 by means of a restrained coupling in the form of a tapered bushing 14 between the roll and the shaft as well as keys 15 provided in the front of the supports 16, 17 placed at the two sides of the rolls and fitting in appropriate housings on the head sides of each of said rolls 12, 13.

Other types of coupling, e.g. between complementary sections born respectively by the roll and the support also, fall within the scope of the invention.

The invention provides that the entire stand 26, formed by the shafts 2, 3, the upright 4 with the bearings 9, 10, the axial adjustment bushing 11, the eccentric support mechanism 8', 8'', the supports 16, 17, roll 12, 13 and the upright 5, is removable from and mountable on the front wall of the frame 6 of the drive assembly 27.

The mutual shifting is obtained for example by means of jacks 19 acting in such a manner as to withdraw the entire stand 26 in the direction indicated by the arrow A.

This operation is performed after dsconnection of the hydraulic locking brackets 24.

In accordance with the invention the eccentric support mechanism 8, 8', 8'' constitutes in practice, with the stand 26 mounted on the drive assembly 27, a single piece on account of the coupling 33 which takes place between the element 8 and the element 8' of said mechanism.

The part of the mechanism 8', 8'' included in the stand 26, i.e. between the uprights 4, 5, can be made up either of a single element or can comprise two separate elements made integral with known intermediate means in a coordinated manner.

In the first case, the mechanism 8', 8'' comprises an eccentric support formed by a tubular sleeve which has in an intermediate zone a window for passage of the roll 12.

In the second case there are provided two separate elements, respectively 8' and 8'', which are rigidly coupled by means of one or more motion transmission shafts (not shown in the figures) integral with the elements 8', 8'', e.g. through the gears 28 and 29.

Transmission of motion between the eccentric supports 8 of the drive assembly 27 and 8', 8'' of the stand 26 takes place through means not shown comprising for example a gear which receives motion from a gear 30 of the drive assembly 27 and transfers it through a shaft to one or both of the gears 28, 29 of the eccentric supports 8' and 8''.

The support 8, 8', 8'' can be then operated at two or more points to adjust the center to center distance between the shafts 2, 7 and 3, 7, utilizing in a known manner the eccentricity of the supports 8, 8', 8''.

As already noted, once a stand 26 is mounted on the drive assembly 27 the support mechanism 8, 8', 8'' constitutes a single whole within which are contained, supported and guided either the main bearings 9, 10 relative to the stand 26 or the roller bearings 22, 23 relative to the drive assembly 27.

This solution in its embodiments implies a plurality of advantages as compared to the known cantilevered stand solutions.

It can be seen that, contrary to the known cantilevered assemblies, the assembly 26 in accordance with the invention calls for shafts 2, 3 supported at the sides of the rolls 12, 13 by main bearings 9, 10 which support the entire rolling stress while the roller bearings 22, 23 only support the drive axles 7, being free of any stress typical of the rolling operation.

This implies longer life of the roller bearings 22, 23, smaller size thereof and substantial derating thereof.

As noted above, in accordance with the invention the drive shafts 7 and the respective shafts of the rolls 2, 3 are made essentially and continuously coaxial, any non-coaxiality depending on simple factors of machining and coupling tolerances.

In FIG. 1 there is provided an axial joint 25 which admits of small offset values.

Figure 2:
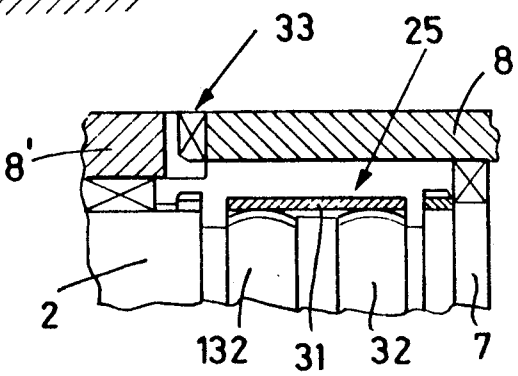
FIG. 2 illustrates a detail of the junction between the motor axle and the roll axle of the assembly in accordance with the invention.

In FIG. 2 there is provided an axial joint 25 which due to the presence of the internally toothed coupling sleeve 31 and toothed sector gears 32, 132 admits of less precise machining and coupling tolerances.

Other types of joints 25 are admissible.

The presence of the joint 25 does not however modify the generative concept of the invention which provides for the shafts 2 and 3 to be continuously coaxial with the respective shafts 7 and the eccentric elements 8' and 8'' which are continuously coaxial with the eccentric element 8.

The idea of the solution is connected with continuous coaxiality and implies considerable advantages in comparison with the measures adopted in known rolling mill stands.

The latter call for the presence of the so-called extensions consisting of shafts with universal joints placed between the gears and the stand shafts with the purpose of transmitting motion even in the absence of coaxiality between the drive output of the gearbox and the axles of the rolling mill rolls.

Contrariwise the stand 1 in accordance with the invention does not require the extensions due to the coupling 33 between the elements 8 and 8' and the continuous coaxiality of the shafts 2 and 3 with the respective drive shafts 7 which are coupled through the joint 25.

After the operation of dismounting the stand 26, releasing the hydraulic bracket 24, the entire stand 26 can be first extracted and replaced and then transported to the shop for maintenance.

It can be noted that, the stand 26 being an independent unit, some operations such as roll grinding and turning can be performed easily after connecting the shafts 2, 3 with specific drive means without the need to dismount the rolls 12, 13.

In any case the invention also provides that the stand 26 can be dismounted, disengaging the upright 5 together with the support 8', the main bearing 10 and the roll support 17 from the axle 2, removing the ringnuts 21 and removing the entire unit from the shaft 20.

In this manner the worn roll 12 can in turn be removed and replaced.

The dismounting operation can be performed either with the upright 5 fixed to the frame 6 after extraction of the ringnuts 21 or in the shop.

To perform the dismounting operation the upright 4 is removed from the shaft 20 in the direction of the arrow A to free the shafts 2, 3 from the support represented by the elements 9 (bearing) and 16 (support ring). The keys 15 free the rings 12, 13 and the tapered bushing 14 is also removed from the position between the roll and the shaft or at least shifted.

In this manner the rolls 12 and 13 are freed from all restraint as regards the shafts 2, 3.

When the upright 4 has reached an end position the rolls 12 and 13, whether worn or no longer useful for the new rolling cycle, can be removed from the shafts 2, 3 and replaced with new rolls 12, 13.

For installation the procedure is then performed in reverse and the movement of the upright (4) on the shafts 20 in the direction of the arrow B causes first insertion of the tapered bushing 14 between the roll and the shaft and subsequently insertion of the keys in the holes provided on the roll.

Finally when the movement has been completed the ring nuts 21 are positioned on the sliding shafts 20 of the uprights. The shafts 20 in the number of 2 or more can be integral with the front 6 and guide the entire stand 26 or be integral with the upright 5 and guide only the upright 4.

The invention has been described for a form of embodiment comprising a stand with horizontal axis.

It includes however forms of embodiment for vertical or inclined stands 26.

We claim:

1. A rolling mill assembly (1) for metal sections equipped with a drive assembly (27) and a removable roll stand (26), first eccentric means (8', 8'') rotatably supporting a first pair of shafts (2, 3) in said stand (26) for coaxial rotation about a first pair of spaced, parallel axes, said drive assembly comprising means (7) for rotating said first pair of shafts in said stand about said first pair of axes, each of said first pair of shafts having thereon a rolling mill roll (12, 13) locked between two supports (16, 17), said drive assembly (27) having a front frame (6), said first pair of shafts (2, 3) supporting coaxially thereon, and in an axially removable manner, said rolls (12, 13), each of said first pair of shafts (2, 3) being rotatably supported at both ends thereof by said first eccentric means (8', 8'') in a pair of uprights (4, 5) forming said stand (26), one (5) of the uprights of said pair (4, 5) thereof being releasably secured to said front frame (6) thereby removably to mount said stand (26) on said drive assembly (27), said rotating means comprising second eccentric means (8) rotatably supporting a second pair of spaced, parallel shafts (7) in said drive assembly (27) for respective rotation coaxially of said first pair of axes, each of said second pair of shafts being rotatably supported at both ends thereof by said second eccentric means (8), and being releasably coupled coaxially with one of said first pair of shafts (2, 3) when the stand (26) is mounted on the drive assembly (27), means mounting said first and second eccentric means in said stand and in said drive assembly, respectively, and for rotational adjustment about a second pair of spaced, parallel axes extending parallel to and radially offset slightly from said first pair of axes, and means (33) releasably coupling together said first and second eccentric means, whereby rotatable adjustment of one of said eccentric means imparts corresponding rotational adjustment to the other of said eccentric means, said first and second eccentric means (8, 8', 8'') thus being adjustable simultaneously to effect adjustment of the axes of rotation of the two pairs of shafts (2, 3, 7) and the center to center distance adjustment of said rolls (12, 13).

2. Assembly (1) in accordance with claim 1, wherein said first said second eccentric means (8, 8', 8'') being coaxial and connected circumferentially when said stand (26) is mounted on said drive assembly (27).

3. Assembly (1) in accordance with claim 1, wherein said stand (26) is supported in front of the frame (6) of the drive assembly (27).

4. Assembly (1) in accordance with claim 1, up to 5 including support and guide shaft means (20) are positioned in front of the frame (6) of the drive assembly (27) and operate to position said stand (26).

5. Assembly (1) in accordance with claim 1, wherein said first eccentric means (8', 8'') includes in said stand (26) two adjustable elements, and there being present means to effect simultaneous connection and adjustment of said elements relative to said uprights (4, 5).

6. Assembly (1) in accordance with claim 5, wherein said means of sumultaneous connection and adjustment are made up of a shaft with gears working with gears (28, 29) present in the first eccentric means (8', 8'').

7. Assembly (1) in accordance with claim 1, wherein said second eccentric means (8) of the drive assembly (27) and said first eccentric means (8', 8'') of the cantilevered stand (26) are at least circumferentially interconnected (33).

* * * * *